US005092523A

United States Patent [19]

Rucker et al.

[11] Patent Number: 5,092,523

[45] Date of Patent: Mar. 3, 1992

[54] MAGNETIC DRIVE TANK CLEANING APPARATUS

[75] Inventors: Jon A. Rucker, Avery; Bart D. Ancheta, San Mateo; Raymond H. Brown, San Francisco, all of Calif.

[73] Assignee: Sybron Chemicals, Inc., Birmingham, N.J.

[21] Appl. No.: 613,925

[22] Filed: Nov. 5, 1990

Related U.S. Application Data

[63] Continuation of Ser. No. 312,182, Feb. 21, 1989, abandoned.

[51] Int. Cl.[5] ..... B05B 3/04

[52] U.S. Cl. ..... 239/240; 239/243; 239/263.3

[58] Field of Search ..... 239/240-242, 239/237, 243, DIG. 1, 263.3; 403/DIG. 1

[56] References Cited

U.S. PATENT DOCUMENTS

| | | | |
|---|---|---|---|
| 2,766,065 | 10/1956 | Joyslen | 239/240 X |
| 3,028,737 | 4/1962 | Rudisch . | |
| 3,163,188 | 12/1964 | Morris | 403/DIG. 1 |
| 3,181,729 | 5/1965 | Milonas et al. . | |
| 3,275,241 | 9/1966 | Saad | 139/240 X |
| 3,326,468 | 6/1967 | Bristow et al. | 239/240 X |
| 3,625,425 | 12/1971 | Robinson . | |
| 3,854,664 | 12/1974 | Hunter | 239/240 X |
| 4,065,234 | 12/1977 | Yoshiyuki et al. . | |
| 4,115,040 | 9/1978 | Knorr . | |
| 4,120,618 | 10/1978 | Klaus . | |
| 4,152,099 | 5/1979 | Bingler . | |
| 4,489,741 | 12/1984 | Ogasawara | 239/263.3 X |
| 4,590,030 | 5/1986 | Gillner et al. . | |
| 4,678,124 | 7/1987 | Hafner et al. . | |

OTHER PUBLICATIONS

March Manufacturing Inc., "Seal-Less Magnetic Drive Pumps", 1983.

"Magnet Drive Gear Pump", Series 13A, Brochure 001A, 5/85, Micropump.

"MK Series Magnetic Drive Centrifugal Chemical Pumps", LaBour Pump Company.

Tuthill Magnetically, 1983, Tuthill Corporation.

Internal Cleaning of Tanks, System TWK, Uraca Rotating Heads"Motodecap".

Spray-Rinse Valve, Fetterolf Corporation, Bulletin-S-R-58C.

High Performance Magnetic Drive Construction Features.

*Primary Examiner*—Andres Kashnikow
*Assistant Examiner*—Kevin P. Weldon
*Attorney, Agent, or Firm*—Marjama & Pincelli

[57] ABSTRACT

A fluid driven tank cleaning which includes a housing having a fluid receiving chamber, and inlet for connecting the receiving chamber to a source of fluid under pressure, and a secondary chamber separated from the receiving chamber by a common wall as a primary drive shaft rotatably mounted within the receiving chamber. A drive impeller is connected to the primary drive shaft and disposed within the inlet is provided for rotating the primary drive shaft in response to fluid entering the housing. A second drive shaft is rotatably mounted within the secondary chamber. A magnetic drive coupler is provided for magnetically coupling the primary shaft with the secondary shaft such that the secondary shaft will rotate in response to rotation of the primary shaft. A fluid nozzle assembly is rotatably mounted to the housing and is fluidly connected to the receiving chamber. A drive train is provided for rotating the fluid nozzle assembly in response to the rotation of the secondary shaft is also provided.

11 Claims, 2 Drawing Sheets

MAGNETIC DRIVE TANK CLEANING APPARATUS

This is a continuation of application Ser. No. 07/312,182, filed Feb. 21, 1989 now abandoned.

The present invention relates to an apparatus for cleaning the interior surface of chambers; for example, reaction chambers, polymerization tanks, assorted liquid storage tanks, large diameter pipe, and similar type containers.

BACKGROUND OF THE INVENTION

Chemical, food, and beverage processing industries use a variety of process, transportation, and storage vessels which must be periodically cleaned. Typically, such vessels or tanks are cleaned by a spraying apparatus which uses the cleaning fluid to be sprayed within the tank to drive the nozzle spray assembly in a predetermined pattern. Generally these devices include a primary drive shaft which is connected to a gear box located in a separate compartment. A high speed seal and bearing are generally required in the wall through which the shaft passes. Due to the high speed of rotation of this shaft, and the often severe chemical nature of the fluid being passed through the device, the seal and bearing tend to wear rapidly, requiring frequent replacement. Thus, the repair and replacement of such seal bearings has become an important factor in the maintenance of such devices.

Applicants have invented an improved tank cleaning device which eliminates the need of a high speed seal or bearing required in the prior art type devices.

SUMMARY OF THE INVENTION

A fluid driven tank cleaning apparatus which includes a housing having a fluid receiving chamber, an inlet for connecting the receiving chamber to a source of fluid under pressure, and a secondary chamber separated from the receiving chamber by a common wall as a primary drive shaft rotatably mounted within the receiving chamber. Drive means connected to the primary drive shaft and disposed within the inlet is provided for rotating the primary drive shaft in response to fluid entering the housing. A second drive shaft is rotatably mounted within the secondary chamber. A magnetic drive coupling means is provided for magnetically coupling the primary shaft with the secondary shaft such that the secondary shaft will rotate in response to rotation of the primary shaft. A fluid nozzle assembly is rotatably mounted to the housing and is fluidly connected to the receiving chamber. Means for rotating the fluid nozzle assembly in response to the rotation of the secondary shaft is also provided.

DETAILED DESCRIPTION OF THE INVENTION

Figure 1:
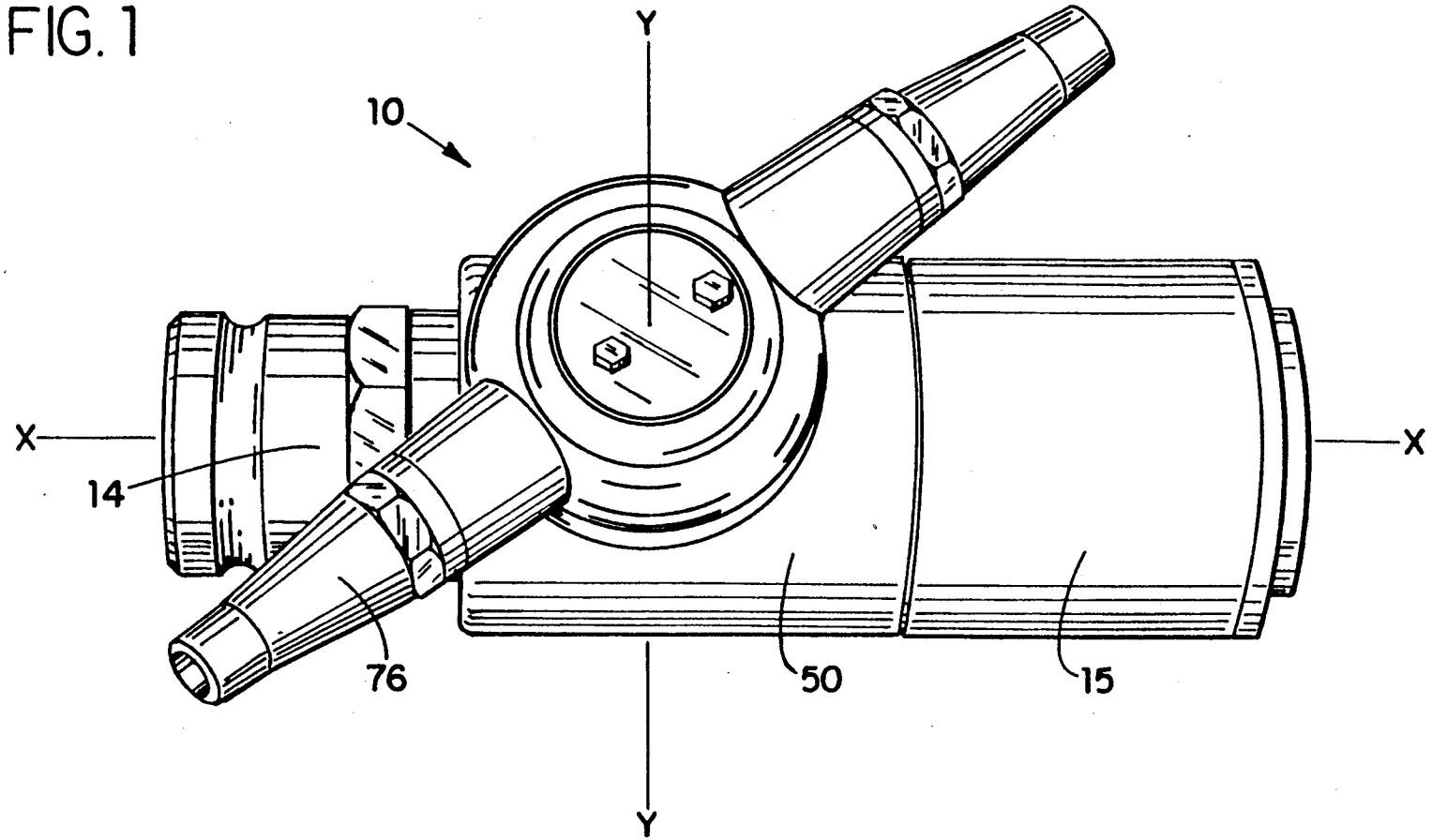
FIG. 1 illustrates a perspective view of an apparatus made in accordance with the present invention.
Figure 2:
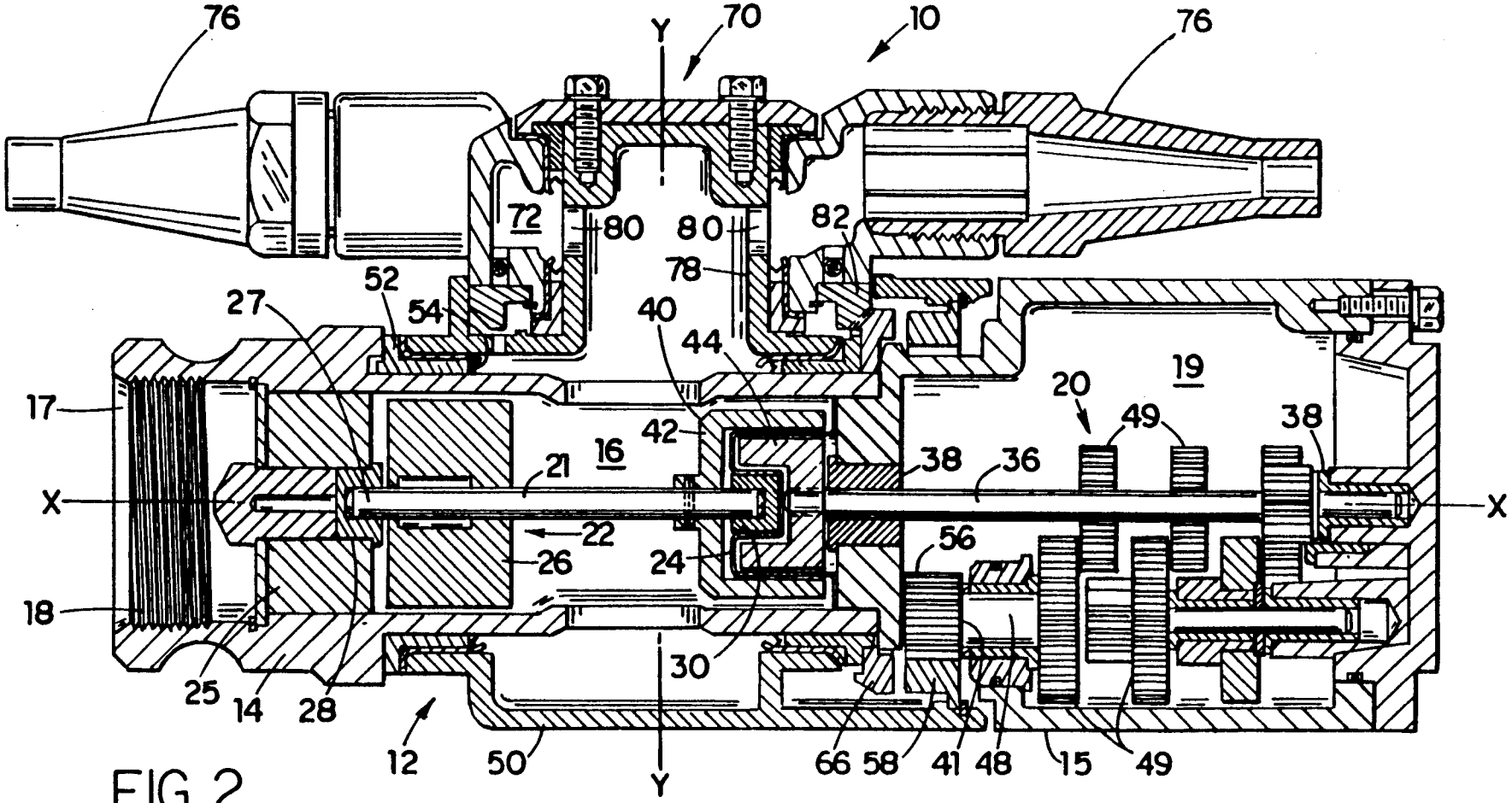
FIG. 2 is a cross-sectional view taken along line 2—2 of FIG. 1.

Referring to FIGS. 1 and 2, there is illustrated a fluid driven tank cleaning apparatus 10 made in accordance with the present invention. The apparatus includes a housing 12 which comprises an inlet stem 14 secured to a gear train housing 15. Inlet stem 14 has an inlet 17 for connection to a source of cleaning fluid under pressure. Typically, the cleaning fluid is pressurized from about 40 to 250 psi. In the particular embodiment illustrated, the inlet stem 14 is provided with internal threads 18 which are capable of being connected to an appropriate coupling (not shown) having a corresponding male threaded section. It is, of course, understood that the inlet stem 14 may be connected in any desired manner to the source of cleaning fluid. The inlet stem 14 is fluidly connected to receiving chamber 16 in inlet stem 14. The housing 12 is further provided with a secondary chamber 19 in gear train housing 15 which is separated from receiving chamber 16 by a common wall 24. A gear train 20 is provided in secondary chamber 19 which is used to drive certain other parts of the tank cleaning apparatus 10 as will be later described herein.

Rotatably mounted within receiving chamber 16 is a primary drive shaft 21. Mounted at the forward end of receiving chamber 16 is drive means 22 for rotating drive shaft 21 in response to fluid flowing entering housing 12. In the particular embodiment illustrated, drive means 22 is a turbine which comprises a stator 25 secured to inlet stem 14 and a rotor 26 secured to primary shaft 21 for rotation therewith. The forward end 27 of shaft 21 is rotatably mounted to a bearing 28 secured to stator 25 and the rearward end 29 of shaft 21 is rotatably mounted to bearing 30 secured to common wall 24. As the fluid under pressure enters and passes by stator 25 and rotor 26, this causes the rotor 26 to rotate, which in turn causes the primary shaft 21 to rotate about axis X—X. Rotatably mounted within secondary chamber 19 is a secondary drive shaft 36 used to drive gear train 20 mounted in secondary chamber 19. The secondary drive shaft 36 is rotatably mounted within housing 12 by bearings 38 secured to housing 12 as is customarily done. Primary shaft 21 is rotatably connected to the secondary drive shaft 36 by magnetic drive coupling means 40. The magnetic drive coupling means 40 comprises a drive magnet 42 secured at the rear end of primary drive shaft 21 adjacent wall 24 and a driven magnet 44 secured at the forward end of shaft 36 closely adjacent wall 24 in close proximity to drive magnet 42. Drive magnet 42 and driven magnet 44 are of the type presently available in the market place. Drive magnet 42 and driven magnet 44 may be secured to shafts 20, 26, respectively, in any desired manner as is customarily done in the prior art. In the preferred embodiment as illustrated, the drive magnet 42 is substantially cup-shaped and the driven magnet 44 is substantially cylindrical-shaped and fits within the cup portion of the drive magnet 42. It is believed that this configuration is most efficient in transferring torque to secondary drive shaft 36. However, it is to be understood the configuration of magnetic drive coupling means 40 may take any other shape so desired. Common wall 24 is shaped in a corresponding manner so as to be placed approximately midway between drive magnet 42 and driven magnet 44. Preferably wall 24 is made as thin as practical while still maintaining appropriate structural strength and the magnets 42, 44 are placed as close as possible to common wall 24 and still provide the appropriate clearance. The wall 24 is made of a nonmagnetic material so as to not interfere with the magnetic coupling between drive magnet 42 and driven magnet 44. In the embodiment illustrated, wall 24 is made of 316 stainless steel which is the same material as gear train housing 15 in the embodiment illustrated. Since the drive magnet 42 is magnetically coupled to driven magnet 44 when primary shaft 21 is rotated, this will cause the driven magnet 44 to rotate thus causing rotation of secondary shaft about its axis. In order to improve the resistance of drive magnet 42 and driven magnet 44 to the corrosive effect of the fluid in which they immersed, they may be provided with a thin outer layer or coating of a protective material, for example, a corrosive resistant plastic.

The secondary shaft 36 provides the input to gear train 20, which includes an output shaft 48 which is connected to secondary shaft 36 by an appropriate number of gears 49 mounted to housing 10. Gear train 20 is used to reduce the rotational speed of output shaft 48 to a desired rpm. It is to be understood that the gears 49 of gear train 20 are selected and arranged so as to provided any desired output rotational speed to output shaft 48. Chamber 14 of gear housing 15 is typically filled with an appropriate lubricant as is typically used in prior art devices.

The apparatus 10 further includes a Tee-housing 50 which is rotatably mounted to inlet stem 14 by a pair of bearings 52 and adjacent seals 54 for rotation about longitudinal axis X—X. The outward end 41 of output shaft 48 has a pinion gear 56 secured thereto for driving spur gear 58 which is secured to Tee-housing 50. Rotation of spur gear 58 causes Tee-housing 50 to rotate about inlet stem 14. A drive bevel gear 66 is also secured to gear train housing 15 such that it is relatively stationary therewith.

Apparatus 10 further includes a nozzle carrier assembly 70 which is rotatably mounted to Tee-housing 50 which includes a body which is a receiving chamber 72 for receiving a liquid directly from nose section 78 of Tee-housing 50 through openings 80 in nose section 78 which is direct fluid communication with receiving chamber 16. At least one spray nozzle 76 is mounted thereto for rotation about axis Y—Y for spraying a liquid against the inside of a tank. It is to be understood that the nozzle carrier assembly 70 is typical of prior art devices, and may take a variety of other forms and shapes as presently exists, or may be developed in the future. The nozzle assembly 70 further includes a driven bevel gear 82 which is designed to engage drive bevel gear 66 secured to gear train housing 15.

In order to more fully understand the present invention, a brief description of the operation of the apparatus 10 will be discussed. A fluid under pressure enters inlet 14 and passes through stator 25 and rotor 26. This fluid flow causes rotor 26 to rotate, thus causing primary shaft 21 to also rotate about its longitudinal axis X—X. Drive magnet 42 rotates with shaft 21, which in turn, causes the driven magnet 44 to rotate in response thereto. This causes the secondary shaft 46 to rotate so as to drive gear train 20 and output shaft 48. The output shaft 48, in turn, drives pinion gear 56 which causes spur gear 58 to rotate which causes Tee-housing 50 to rotate about longitudinal axis X—X. While Tee-housing 50 is rotating along longitudinal axis X—X, drive bevel gear 66 engages driven bevel gear 82 through an opening in Tee-housing 50 which causes the nozzle carrier assembly 70 to rotate about axis Y—Y.

It is to be understood that various changes and modifications may be made without departing from the scope of the present invention. For example, but not by way of limitation, the shape of driven magnet 44 and drive magnet 42 may be varied as desired to any other mating relationship or simply be revised in configuration. The present invention being limited by the following claims.

What is claimed:

1. A fluid driven tank cleaning apparatus comprising:

a housing having an inlet stem and gear train housing, said inlet stem having a fluid receiving chamber and an inlet for connecting said fluid receiving chamber to a source of fluid under pressure, said gear train housing having a secondary chamber separated from said receiving chamber by a common wall;

a primary drive shaft rotatably mounted within said receiving chamber;

drive means connected to said primary drive shaft and disposed within said inlet for rotating said primary drive shaft in response to fluid entering said housing;

a secondary drive shaft rotatably mounted within said secondary chamber, said secondary chamber having a lubricating fluid disposed therein;

magnetic drive coupling means for magnetically coupling said primary shaft with said secondary shaft so as to cause said secondary shaft to rotate in response to rotation of said primary shaft;

gear reduction means disposed in said secondary chamber and connected to said secondary shaft for reducing the rotational speed of said secondary shaft;

a Tee-housing rotatably mounted to said housing so as to rotate about a first axis;

an output shaft rotatably mounted within said secondary chamber and connected to said secondary shaft through said gear reduction means;

a fluid nozzle assembly rotatably mounted to said Tee-housing about a second axis, said fluid nozzle assembly being fluidly connected to said fluid receiving chamber;

means for connecting said output shaft to said nozzle assembly so as to cause said nozzle assembly to rotate about said secondary axis in a predetermined manner.

2. A fluid driven tank cleaning apparatus according to claim 1 wherein said magnetic drive coupling means comprises a drive magnet secured to the rearward end of said primary drive shaft adjacent to said common wall and said driven magnet secured to the forward end of said secondary drive shaft adjacent to said common wall.

3. A fluid driven tank cleaning apparatus according to claim 2 wherein said drive magnet has a substantially cup-shaped configuration and said driven magnet having a generally cylindrical shaped configuration, said common wall being configured to allow placement of said drive magnet within said drive magnet.

4. A fluid driven tank cleaning apparatus according to claim 3 wherein said common wall is made of 316 stainless steel.

5. A fluid driven tank cleaning apparatus according to claim 1 wherein said drive means comprises a stator secured within said inlet of said inlet stem and a rotor secured to the forward end of said primary shaft adjacent to said stator.

6. A fluid driven tank cleaning apparatus 1 wherein said means for connecting said output shaft to said nozzle assembly includes a drive bevel gear secured to said gear train housing which engages a driven bevel gear secured to said nozzle assembly.

7. A fluid driven tank cleaning apparatus comprising:

a housing having a fluid receiving chamber, an inlet for connecting said receiving chamber to a source of fluid under pressure, and a secondary chamber separated from said receiving chamber by a common wall;

a primary drive shaft rotatably mounted within said receiving chamber, said primary drive shaft having a forward end and a rearward end;

drive means connected to said primary drive shaft and disposed within said inlet for rotating said primary drive shaft in response to fluid entering said housing;

a secondary drive shaft rotatably mounted within said secondary chamber, said secondary chamber having a lubricating fluid disposed therein;

magnetic drive coupling means for magnetically coupling said primary shaft within said secondary shaft so as to cause said secondary shaft to rotate in response to rotation of said primary shaft;

a fluid nozzle assembly rotatably mounted to said housing and fluidly connected to said first receiving chamber; and means for rotating said fluid nozzle assembly in response to rotation of said secondary shaft.

8. A fluid driven tank cleaning apparatus according to claim 7 wherein said magnetic drive coupling means comprises drive magnet secured to the rearward end of said primary drive shaft adjacent to said common wall and said driven magnet secured to the forward end of said secondary drive shaft adjacent to said common wall.

9. A fluid driven tank cleaning apparatus according to claim 8 wherein said drive magnet has a substantially cup-shaped configuration and said driven magnet having a generally cylindrical shaped configuration, said common wall between said receiving chamber and secondary chamber being configured to allow placement of said drive magnet within said drive magnet.

10. A fluid driven tank cleaning apparatus according to claim 9 wherein said common wall is made of 316 stainless steel.

11. A fluid driven tank cleaning apparatus according to claim 10 wherein said drive means comprises a stator secured within said inlet of said inlet stem and a rotor secured to the forward end of said primary shaft adjacent to said stator.

* * * * *

US005092523B1

REEXAMINATION CERTIFICATE (3054th)

United States Patent [19] [11] B1 5,092,523

Rucker et al. [45] Certificate Issued Nov. 12, 1996

[54] MAGNETIC DRIVE TANK CLEANING APPARATUS

[75] Inventors: Jon A. Rucker, Avery; Bart D. Ancheta, San Mateo; Raymond H. Brown, San Francisco, all of Calif.

[73] Assignee: Sybron Chemicals Holdings Inc., Wilmington, Del.

Reexamination Request:
No. 90/004,092, Jan. 16, 1996

Reexamination Certificate for:

| | |
|---|---|
| Patent No.: | **5,092,523** |
| Issued: | **Mar. 3, 1992** |
| Appl. No.: | **613,925** |
| Filed: | **Nov. 5, 1990** |

Related U.S. Application Data

[63] Continuation of Ser. No. 312,182, Feb. 21, 1989, abandoned.

[51] Int. Cl.[6] ..... B05B 3/04

[52] U.S. Cl. ..... 239/240; 239/243; 239/263.3

[58] Field of Search ..... 239/240–242, 239/237, 243, 263.3, DIG. 1; 403/DIG. 1

[56] References Cited

U.S. PATENT DOCUMENTS

| | | | |
|---|---|---|---|
| 3,326,468 | 6/1967 | Bristow et al. | 239/227 |
| 3,373,927 | 3/1968 | Miller | 230/116 |
| 3,630,645 | 12/1971 | Eheim | 417/420 |
| 3,854,664 | 12/1974 | Hunter | 239/206 |
| 4,115,040 | 9/1978 | Knorr | 417/420 |

*Primary Examiner*—Kevin Weldon

[57] ABSTRACT

A fluid driven tank cleaning which includes a housing having a fluid receiving chamber, and inlet for connecting the receiving chamber to a source of fluid under pressure, and a secondary chamber separated from the receiving chamber by a common wall as a primary drive shaft rotatably mounted within the receiving chamber. A drive impeller is connected to the primary drive shaft and disposed within the inlet is provided for rotating the primary drive shaft in response to fluid entering the housing. A second drive shaft is rotatably mounted within the secondary chamber. A magnetic drive coupler is provided for magnetically coupling the primary shaft with the secondary shaft such that the secondary shaft will rotate in response to rotation of the primary shaft. A fluid nozzle assembly is rotatably mounted to the housing and is fluid connected to the receiving chamber. A drive train is provided for rotating the fluid nozzle assembly in response to the rotation of the secondary shaft is also provided.

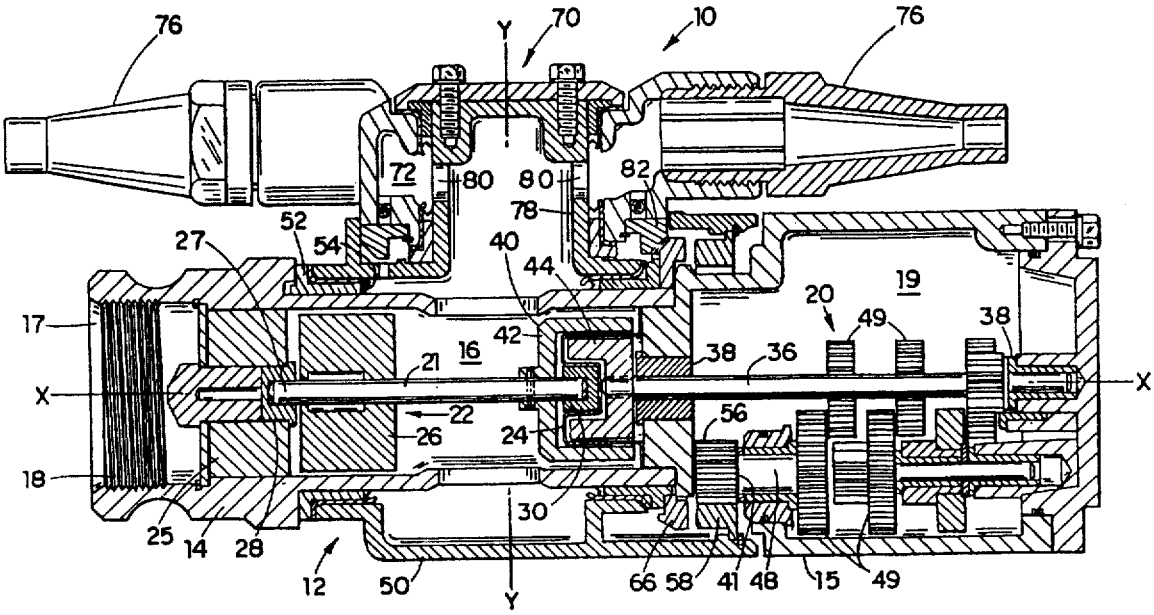

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *